US007387096B2

(12) United States Patent
Tashiro

(10) Patent No.: US 7,387,096 B2
(45) Date of Patent: Jun. 17, 2008

(54) LIFT-VARIABLE VALVE-OPERATING SYSTEMS FOR INTERNAL COMBUSTION ENGINE

(75) Inventor: Masahiko Tashiro, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/822,917

(22) Filed: Jul. 11, 2007

(65) Prior Publication Data

US 2007/0261650 A1 Nov. 15, 2007

Related U.S. Application Data

(63) Continuation of application No. 11/405,678, filed on Apr. 18, 2006, now Pat. No. 7,252,058.

(30) Foreign Application Priority Data

Apr. 28, 2005 (JP) ..... 2005-132599

(51) Int. Cl.
*F01L 1/34* (2006.01)

(52) U.S. Cl. ..... 123/90.16; 123/90.39; 123/90.44; 74/569

(58) Field of Classification Search ..... 123/90.2, 123/90.16, 90.39, 90.44, 90.6, 90.27, 90.31; 74/559, 567, 569
See application file for complete search history.

(56) References Cited

U.S. PATENT DOCUMENTS 6,009,842 A * 1/2000 Hiereth ..... 123/90.27
7,146,949 B2 12/2006 Mendler

FOREIGN PATENT DOCUMENTS

JP 7-63023 3/1995

* cited by examiner

*Primary Examiner*—Ching Chang
(74) *Attorney, Agent, or Firm*—Arent Fox LLP.

(57) ABSTRACT

A lift-variable valve-operating system for an engine, includes a subsidiary cam swingably carried on a movable support shaft. A cam follower is operatively connected to an engine valve and follows the subsidiary cam. The lift amount of the engine valve is varied by displacing the movable support shaft. The subsidiary cam has an oil sump provided in an upper surface and opens upwards to store oil. The subsidiary cam is provided with an abutment face abutting against the cam follower. The abutment face includes a lift portion for turnably driving the cam follower; and a base circle portion connected to the lift portion and which retains the cam follower in a rest state. The subsidiary cam is also provided with a lubricating oil bore for guiding the oil in the oil sump to the base circle portion.

7 Claims, 10 Drawing Sheets

WHEN LIFT IS HIGH

WHEN LIFT IS LOW

WHEN LIFT IS HIGH

WHEN LIFT IS LOW

LIFT-VARIABLE VALVE-OPERATING SYSTEMS FOR INTERNAL COMBUSTION ENGINE

CROSS-REFERENCE TO RELATED APPLICATION

This application is a Continuation of application Ser. No. 11/405,678, filed Apr. 18, 2006 now U.S. Pat. No. 7,252,058. The disclosure of the prior application is hereby incorporated by reference herein in its entirety.

RELATED APPLICATION DATA

The present invention is based upon Japanese priority application No. 2005-132599, which is incorporated in its entirety herein by reference.

BACKGROUND OF THE INVENTION

1. Field of the Invention

The present invention relates to a lift-variable valve-operating system for an internal combustion engine, including a subsidiary cam swingably carried on a movable support shaft that is displaceable in a plane perpendicular to a rotational axis of a valve-operating cam and which swings following the valve-operating cam; and a cam follower operatively connected to an engine valve and which is operated to follow the subsidiary cam, wherein the lift amount of the engine valve is varied by displacing the movable support shaft.

2. Description of the Related Art

Japanese Patent Application Laid-open No. 7-63023 discloses a lift-variable valve-operating system for an internal combustion engine in which a cam follower operatively connected to an engine valve is swung by a rocker lever (subsidiary cam) that is swingably driven by a valve-operating cam. The lift amount of the engine valve is varied by displacing the fulcrum of the rocker lever.

In the known lift-variable valve-operating system, oil must be supplied to the contact portions of the rocker lever and the cam follower in order to lubricate the components. Moreover, it is a desirable feature to simplify the structure of such a lubricating structure. However, the lubricating structure in the known system disclosed by Japanese Patent Application Laid-open No. 7-63023 does not have a simple structure.

SUMMARY OF THE INVENTION

Accordingly, it is an aspect of the present invention to provide a lift-variable valve-operating system for an internal combustion engine wherein oil is supplied to the contacting portions of the subsidiary cam and the cam follower in order to lubricate the components using a relatively simple structure.

In order to attain such an aspect, according to a first feature of the present invention, there is provided a lift-variable valve-operating system for an internal combustion engine, which includes a subsidiary cam swingably carried on a movable support shaft that is displaceable in a plane perpendicular to a rotational axis of a valve-operating cam and which swings following the valve-operating cam. A cam follower operatively connected to an engine valve is operated to follow the subsidiary cam. The lift amount of the engine valve is varied by displacing the movable support shaft. The inventive system further includes a control arm connected to the movable support shaft and which is turnable about an axis parallel to the rotational axis of the valve-operating cam. A driver turnably drives the control arm, wherein the subsidiary cam, which has an oil sump provided in an upper surface and opens upward to store oil therein, is provided with an abutment face and a lubricating oil bore. The abutment face abuts against the cam follower. A lift portion of the abutment face turnably drives the cam follower. A base circle portion connected to the lift portion and equally spaced from the axis of the movable support shaft retains the cam follower in a rest state. The lubricating oil bore guides the oil in the oil sump to the base circle portion.

With the first feature, lubrication of the contacting portions of the subsidiary cam and the cam follower is performed using a relatively simple structure in which oil is supplied from the oil sump in the upper surface of the subsidiary cam, through the lubricating oil bore and to the abutment face provided on the subsidiary cam in order to abut against the cam follower. Moreover, the lubricating oil bore opens into the base circle portion of the abutment face that does not receive a relatively large load. Accordingly, any concerns about the rigidity of the subsidiary cam decreasing due to the provision of the lubricating oil bore is eliminated.

According to a second feature of the present invention, the movable support shaft swingably supporting the subsidiary cam is detachably mounted to the control arm.

With the second feature, the subsidiary cam is removable without detaching the other components, thereby simplifying and facilitating the replacement of parts. In addition, although it is difficult to form a lubricating oil passage within the movable support shaft because the movable support shaft is attachable to, and detachable from, the control arm, lubricating the contacting portions of the subsidiary cam and the cam follower is easily carried out using the oil supplied from the oil sump provided in the subsidiary cam through the lubricating oil bore.

According to a third feature of the present invention, a spacer, which is separate from the movable support shaft, is fitted over an outer periphery of the movable support shaft swingably supporting a plurality of the subsidiary cams, wherein the spacer is interposed between the subsidiary cams.

With the third feature, even when the plurality of subsidiary cams are swingably carried on the movable support shaft, the spacer is interposed between the subsidiary cams, wherein the positions of the subsidiary cams are defined in a direction along the axis of the movable support shaft, while simplifying the shape of the movable support shaft.

The above and other aspects, features and advantages of the invention will become apparent from the following description of the preferred embodiments taken in conjunction with the accompanying drawings.

DETAILED DESCRIPTION OF PREFERRED EMBODIMENTS

Figure 1:
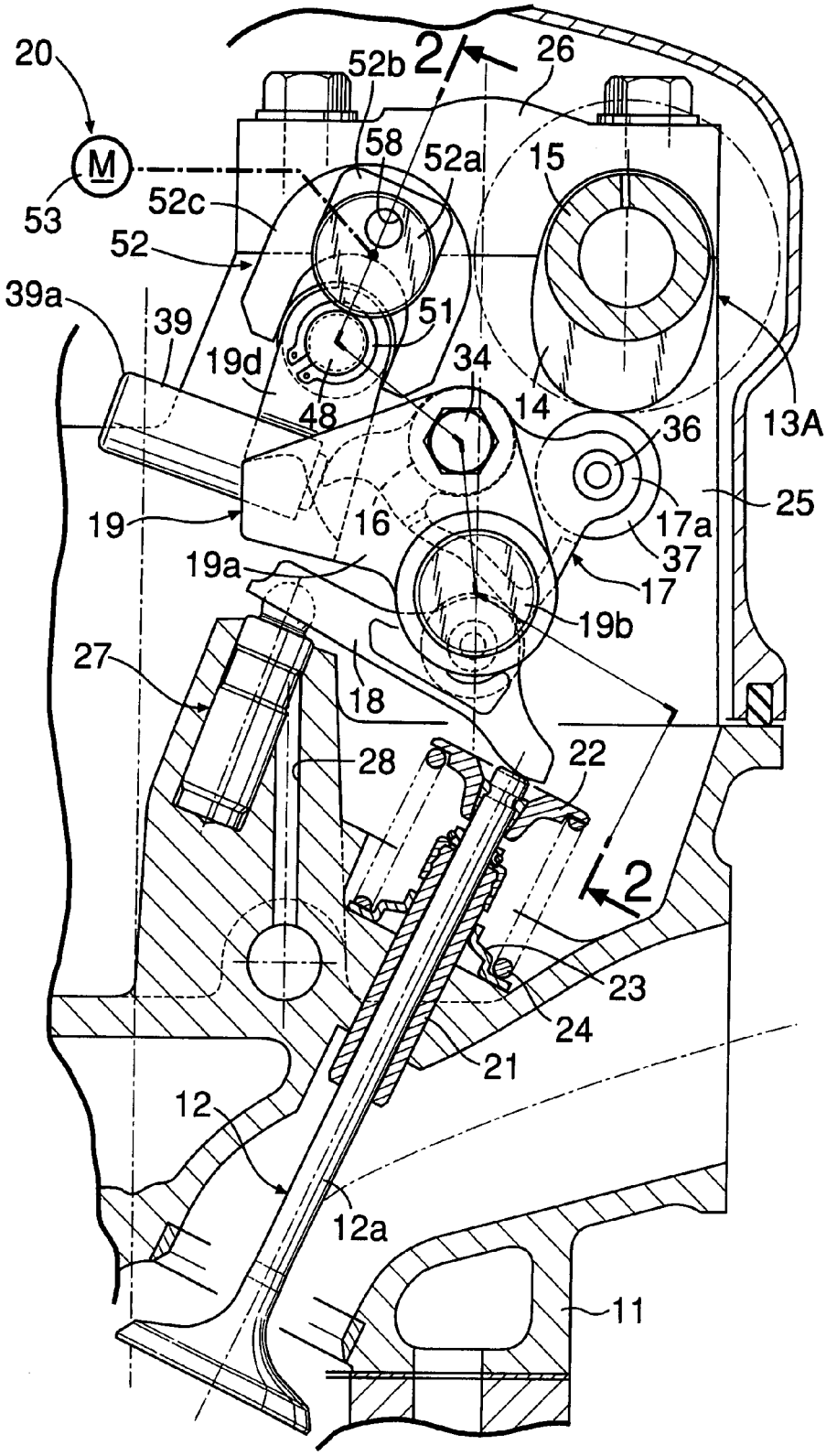
FIG. 1 is a vertical cross-sectional side view of a lift-variable valve-operating system for an internal combustion engine according to a first embodiment of the present invention.
Figure 2:
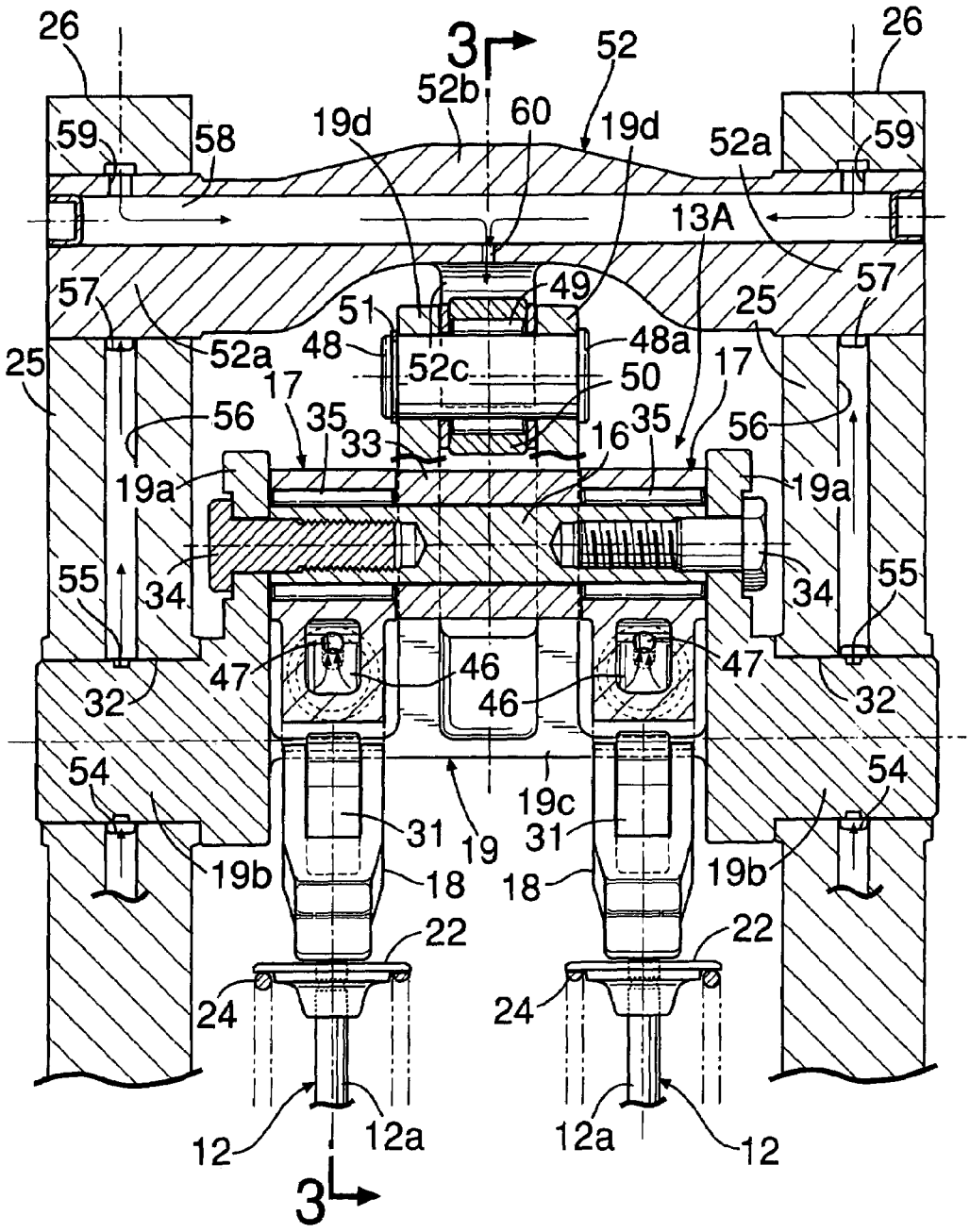
FIG. 2 is a cross-sectional view taken along line 2-2 in FIG. 1.

Referring to FIGS. 1 to 5, a pair of intake valves 12, which are engine valves, are operably and closably disposed for each cylinder in a cylinder head 11 of an internal combustion engine. A valve operating system 13A for opening and closing the intake valves 12 includes a camshaft 15 having valve-operating cams 14 provided thereon to individually correspond to the intake valves 12; a pair of subsidiary cams 17, 17 swingably carried on a movable support shaft 16 that is displaceable in a plane perpendicular to the rotational axes of the valve-operating cams 14, i.e., an axis of the camshaft 15, and which swing following the respective valve-operating cams 14; a pair of cam followers 18, 18, each follower 18 being operatively connected to the intake valves 12 and adapted to follow the subsidiary cams 17; a control arm 19 connected to the movable support shaft 16 and turnable about an axis parallel to the axis of the camshaft 15; and a driver 20 for turnably driving the control arm 19, wherein the lift amount for the intake valves 12 is varied by displacing the movable support shaft 16.

Stems 12*a* of the intake valves 12 are slidably fitted within guide tubes 21 disposed in the cylinder head 11. The intake valves 12 are biased in a closing direction by valve springs 24 interposed between retainers 22 mounted at upper ends of the stems 12*a* and retainers 23 mounted to abut against the cylinder head 11.

Cam holders 26, 25 are mounted in the cylinder head 11 and disposed on opposite sides of the intake valves 12. Caps 26, 26 are fastened to upper surfaces of the cam holders 25 and rotatably support the camshaft 15 in cooperation with the cam holders 25.

The cam followers 18, 18 are swingably carried at one end thereof on the cylinder head 11 with hydraulic tappets 27 interposed therebetween. An oil passage 28 is provided which leads to the hydraulic tappets 27. The other end of the cam followers 18 abut against upper ends of the stems 12*a* of the intake valves 12. Further, first rollers 31 are supported at intermediate portions of the cam followers 18 with needle bearings 30 interposed therebetween, so that the rollers 31 are in rolling contact, respectively, with the subsidiary cams 17.

The control arm 19 is formed into an integral crank-shape including webs 19*a*, 19*a* disposed on opposite sides of the intake valves 12; shaft portions 19*b*, 19*b* perpendicularly connected to outer surfaces of the base ends of the webs 19*a*, 19*a* and have axes parallel to the camshaft 15; and a connecting portion 19*c*, which interconnects leading ends of the webs 19*a*, 19*a*. The shaft portions 19*b* are turnably fitted into support bores 32 provided in the cam holders 25. Thus, the control arm 19 is turnably carried by the cam holders 25.

The movable support shaft 16, which has an axis parallel to the camshaft 15, extends through the subsidiary cams 17 disposed inside the webs 19*a* of the control arm 19 and through a cylindrical spacer 33 interposed between the subsidiary cams 17. Opposite ends of the movable shaft 16 abut against the inner surfaces of the webs 19*a*; bolts 34, 34 inserted through the webs 19*a* threadably engage opposite ends of the movable support shaft 16; and needle bearings 35, 35 are interposed between the movable support shaft 16 and both of the subsidiary cams 17, 17, respectively.

The subsidiary cams 17 are turnably carried by the movable support shaft 16, which is detachably mounted at opposite ends to the webs 19*a* of the control arm 19. Moreover, the spacer 33, which is separate from the movable support shaft 16, is fitted over an outer periphery of the movable support shaft 16, wherein the spacer 33 is interposed between both subsidiary cams 17, 17.

A pair of support arm portions 17*a*, 17*a* are integrally provided in a substantially U-shape on each subsidiary cam 17 at locations corresponding to points between the shaft portions 19*b* of the control arm 19 and the movable support shaft 16 to extend toward the camshaft 15. Second rollers 37 are supported on support shafts 36 fixed between leading ends of the support arm portions 17*a* with needle bearings 38 interposed therebetween, so that the rollers 37 are in rolling contact with the valve-operating cams 14 of the camshaft 15, respectively. Thus, the subsidiary cams 17, 17 are turned about the axis of the movable support shaft 16 by the second rollers 37 contacting the valve-operating cams of the camshaft 15.

Pressure-receiving arm portions 17*b*, 17*b* are integrally provided on the subsidiary cams 17, 17 on sides of the movable support shaft 16 that are opposite from the second rollers 37. Spring forces which bias the subsidiary cams 17 to bring the second rollers 37 into rolling contact with the valve-operating cams 14 are applied to the pressure-receiving arm portions 17*b*.

Bottomed cylindrical guide tubes 39, 39 are integrally provided on the connecting portions 19*c* of the control arm 19 and extend in a direction opposite the subsidiary cams 17. The tubes 39, 39 have end walls 39*a* at ends opposite the subsidiary cams 17, wherein springs 43 are compression mounted between abutment pieces 42 abutting against the pressure-receiving arm portions 17*b* of the subsidiary cams 17 and the end walls 39*a* of the guide tubes 39.

The subsidiary cams 17 have abutment faces 45 provided on lower surfaces, wherein the first rollers 31 of the cam followers 18 are brought into rolling contact with the abutment faces 45. Each abutment face 45 includes a lift portion 45*a* for turnably driving the cam follower 18 and a base circle portion 45*b* equally spaced apart from the movable support shaft 16 to retain the cam follower 18 in a rest state. The lift portion 45*a* and the base circle portion 45*b* are connected to each other. The lift portion 45*a* is formed to extend rectilinearly in such a manner that the distance between a point of contact of the cam follower 18 with the second roller 37 and the axis of the movable support shaft 16 is gradually increased when the subsidiary cam 17 is turned with the turning of the valve-operating cam 14.

Moreover, oil sumps 46 that open upwards and sideways between both support arm portions 17*a*, 17*a* are provided in upper surfaces of the subsidiary cams 17 to receive oil scattered within valve-operating chamber in which the valve-operating system 13A is accommodated. The subsidiary cams 17 have lubricating oil bores 47 provided therein for guiding the oil accumulated in the oil sumps 46 to the base circle portions 45*b*.

A pair of upward-extending arm portions 19*d*, 19*d* are integrally provided at intermediate portions between the guide tubes 39. A third roller 50 is supported on a support shaft 48 mounted between leading ends of the arm portions 19*d* with a needle bearing 49 interposed therebetween. A collar 48*a* provided at one end of the support shaft 48 abuttingly engages an outer surface of one of the arm portions 19*d*. A retaining ring 51 mounted at the other end of the support shaft 48 protrudes out of the other arm portion 19*d* and abuttingly engages an outer surface of the other arm portion 19*d*.

The driver 20 includes a drive shaft 52 having a clamping portion 52*c* for clamping the third roller 50 and is operatively connected to an electric motor 53. The drive shaft 52 integrally includes a pair of shaft portions 52*a*, 52*a* turnably carried between the cam holders 25 and the caps 26. A connecting portion 52*b* interconnects eccentric positions of the shaft portions 52*a*. The clamping portions 52*c* form a substantially C-shape and are provided at a central portion of the connecting portion 52*b*.

Figure 3:
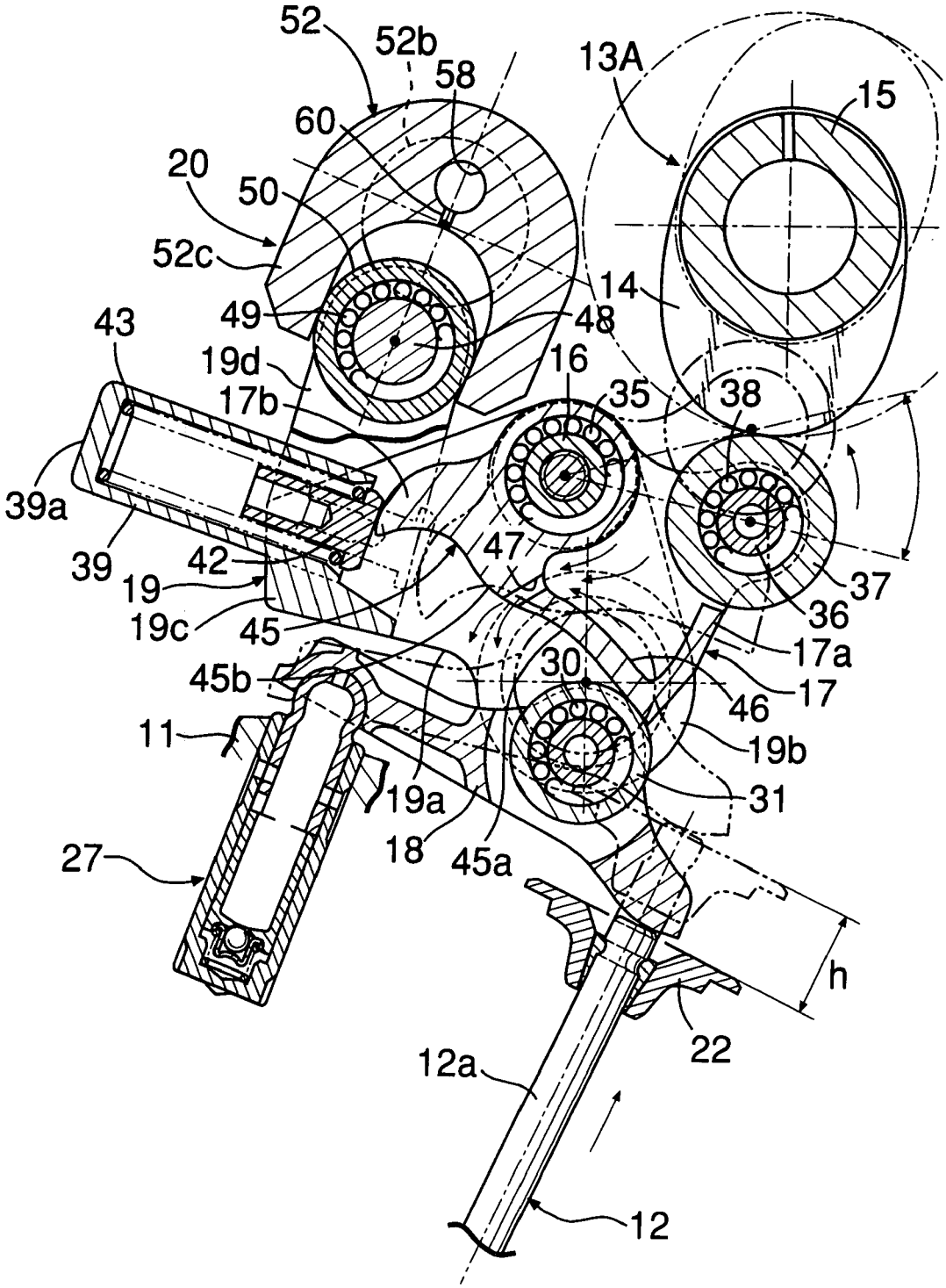
FIG. 3 is a cross-sectional view taken along line 3-3 in FIG. 2 and illustrating a high-lift state.
Figure 4:
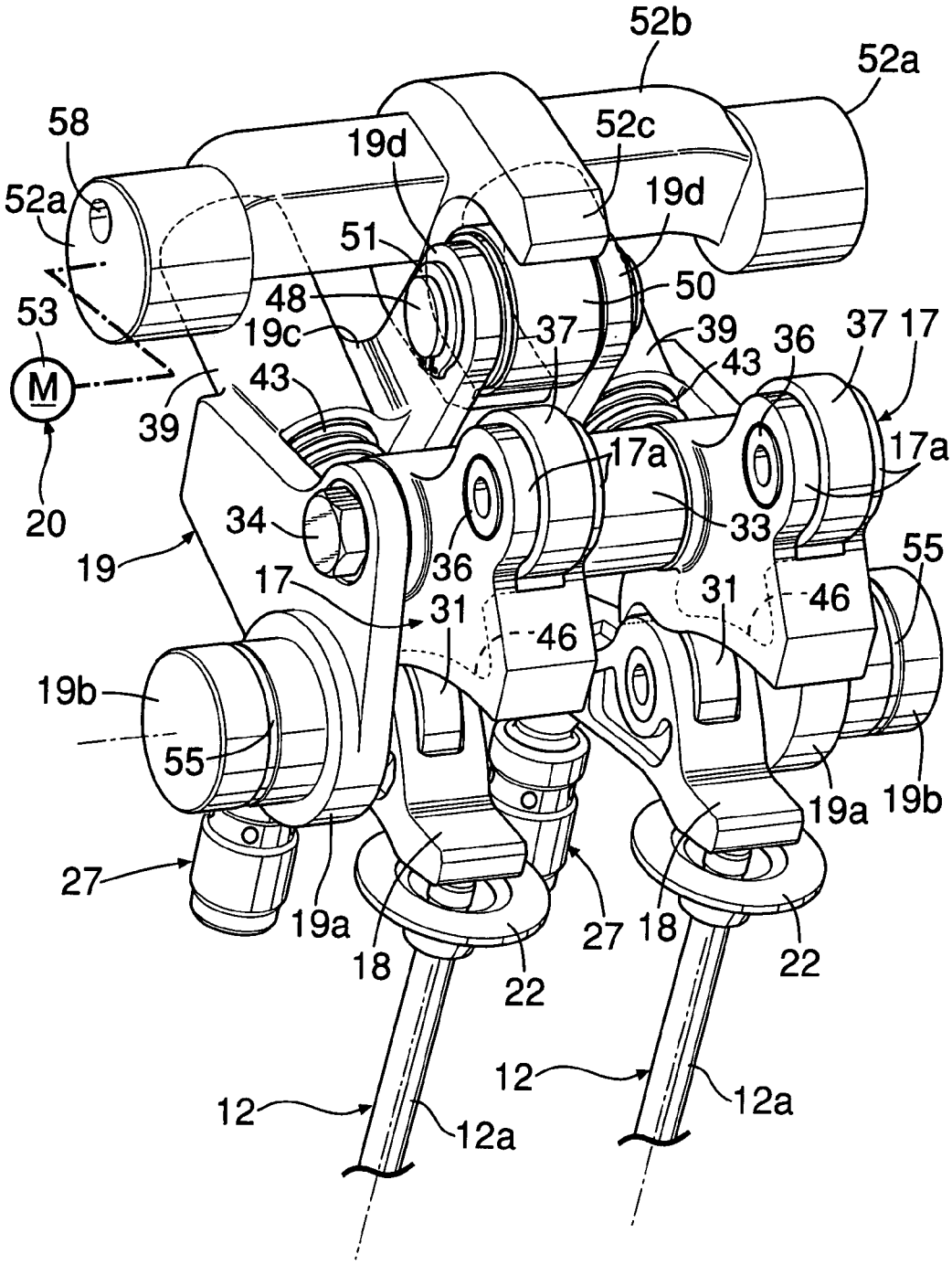
FIG. 4 is a perspective view of the lift-variable valve-operating system according to a first embodiment of the present invention.
Figure 5:
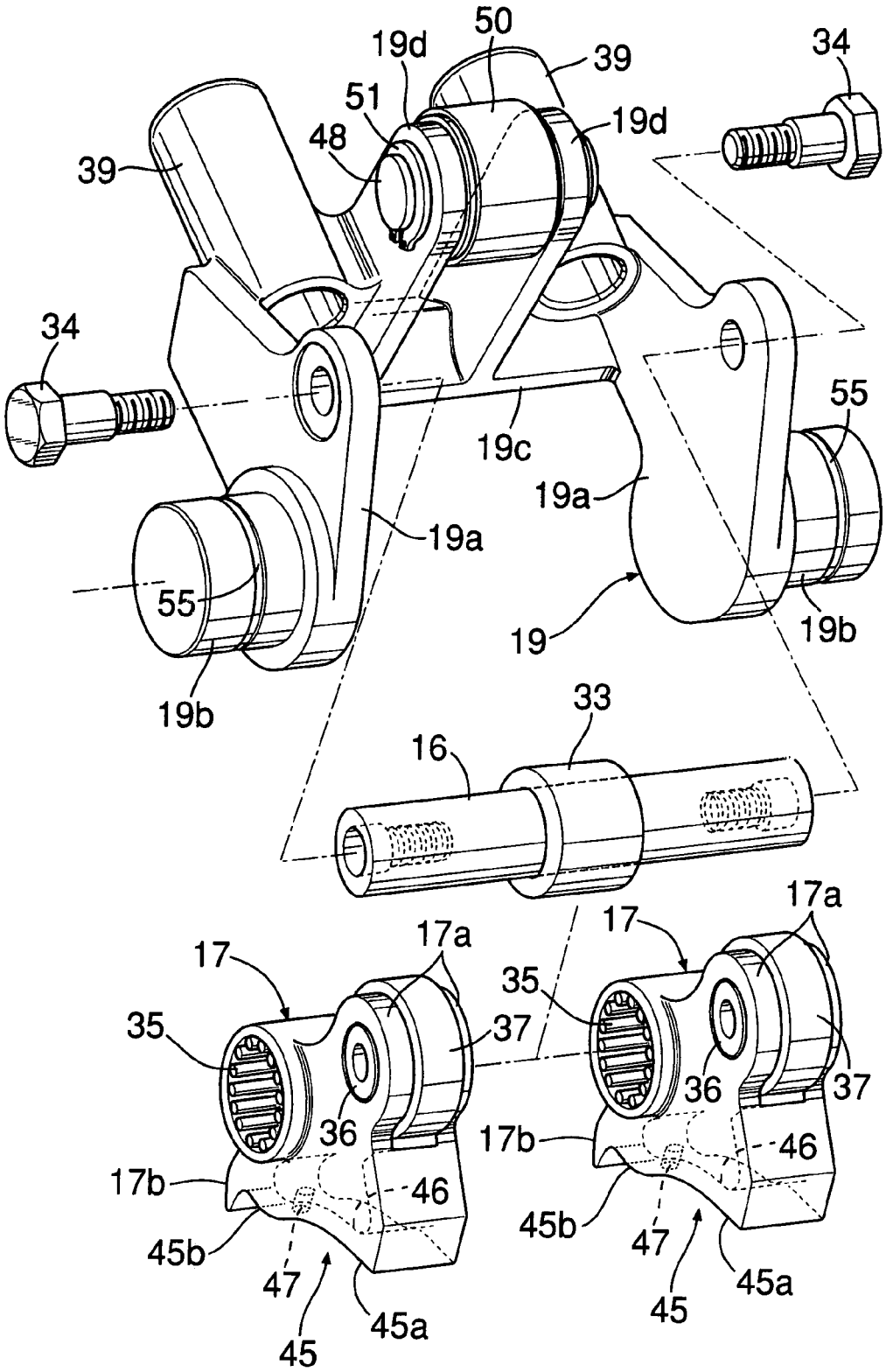
FIG. 5 is an exploded view of the lift-variable valve-operating system illustrated in FIGS. 1-4.
Figure 6:
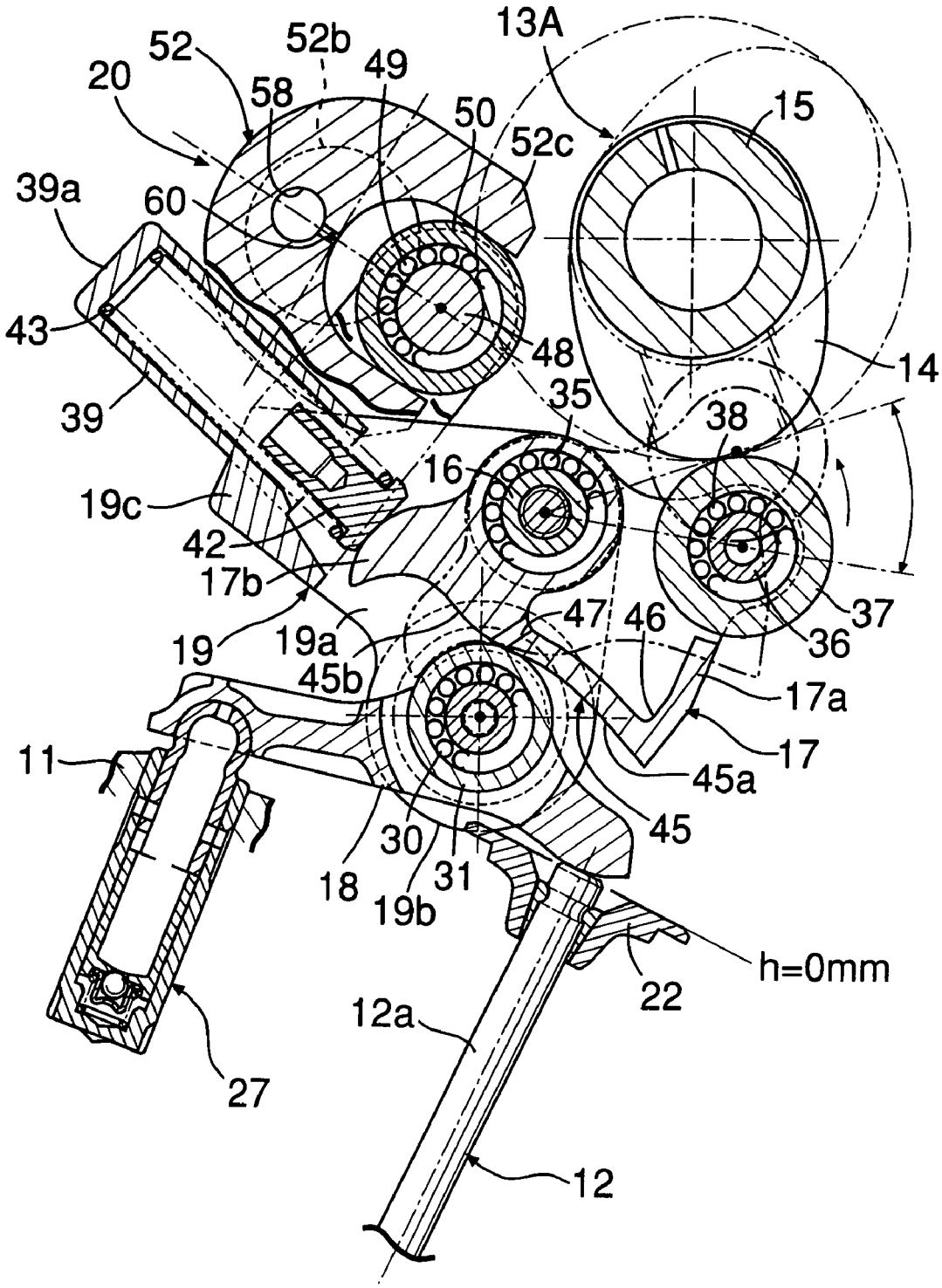
FIG. 6 is a cross-sectional view similar to the view illustrated in FIG. 3, but illustrating a low-lift state.
Figure 7:
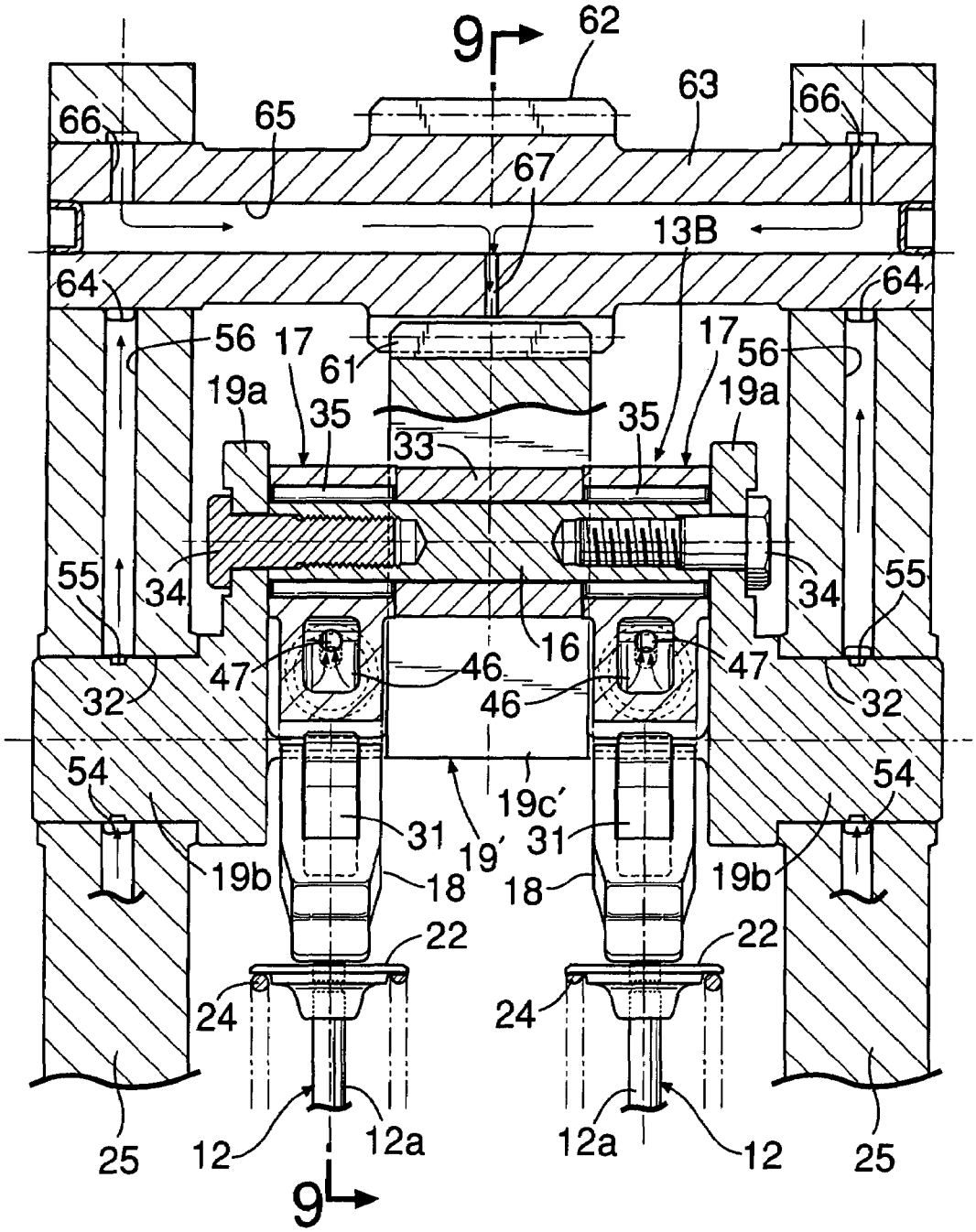
FIG. 7 is a cross-sectional view taken along line 7-7 in FIG. 9 according to a second embodiment of the present invention.
Figure 8:
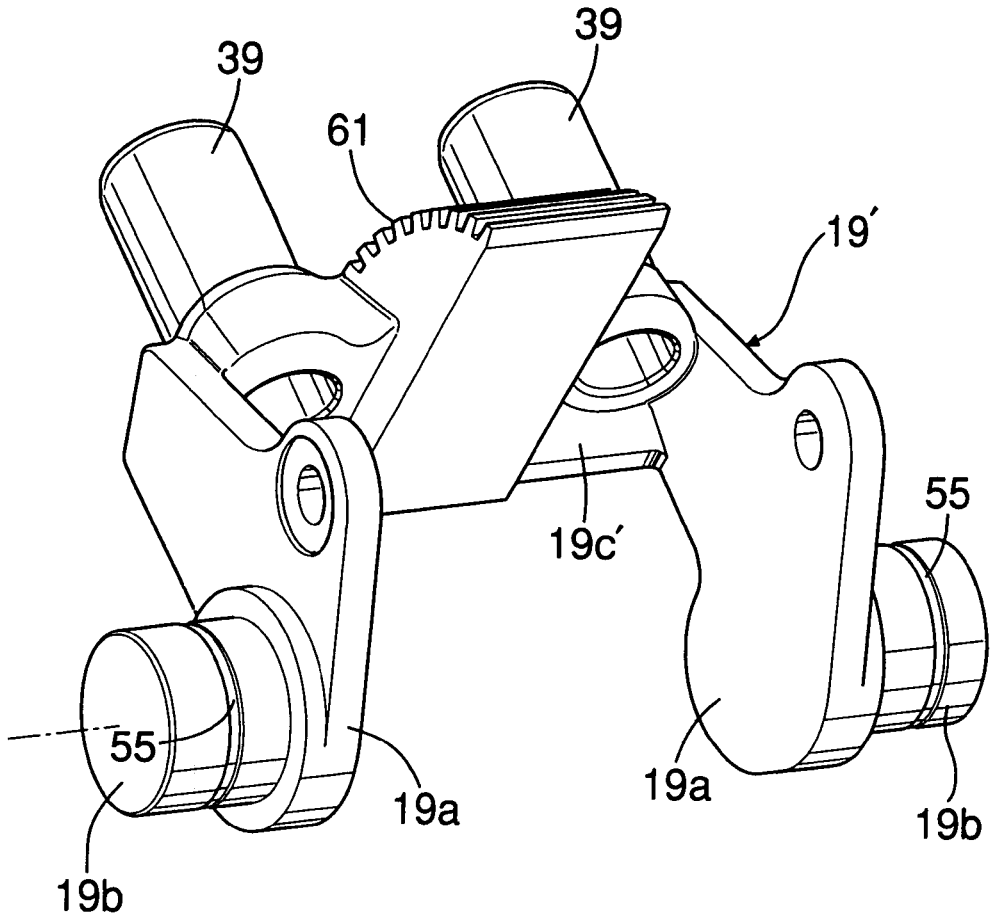
FIG. 8 is a perspective view of a control arm used in the second embodiment.
Figure 9:
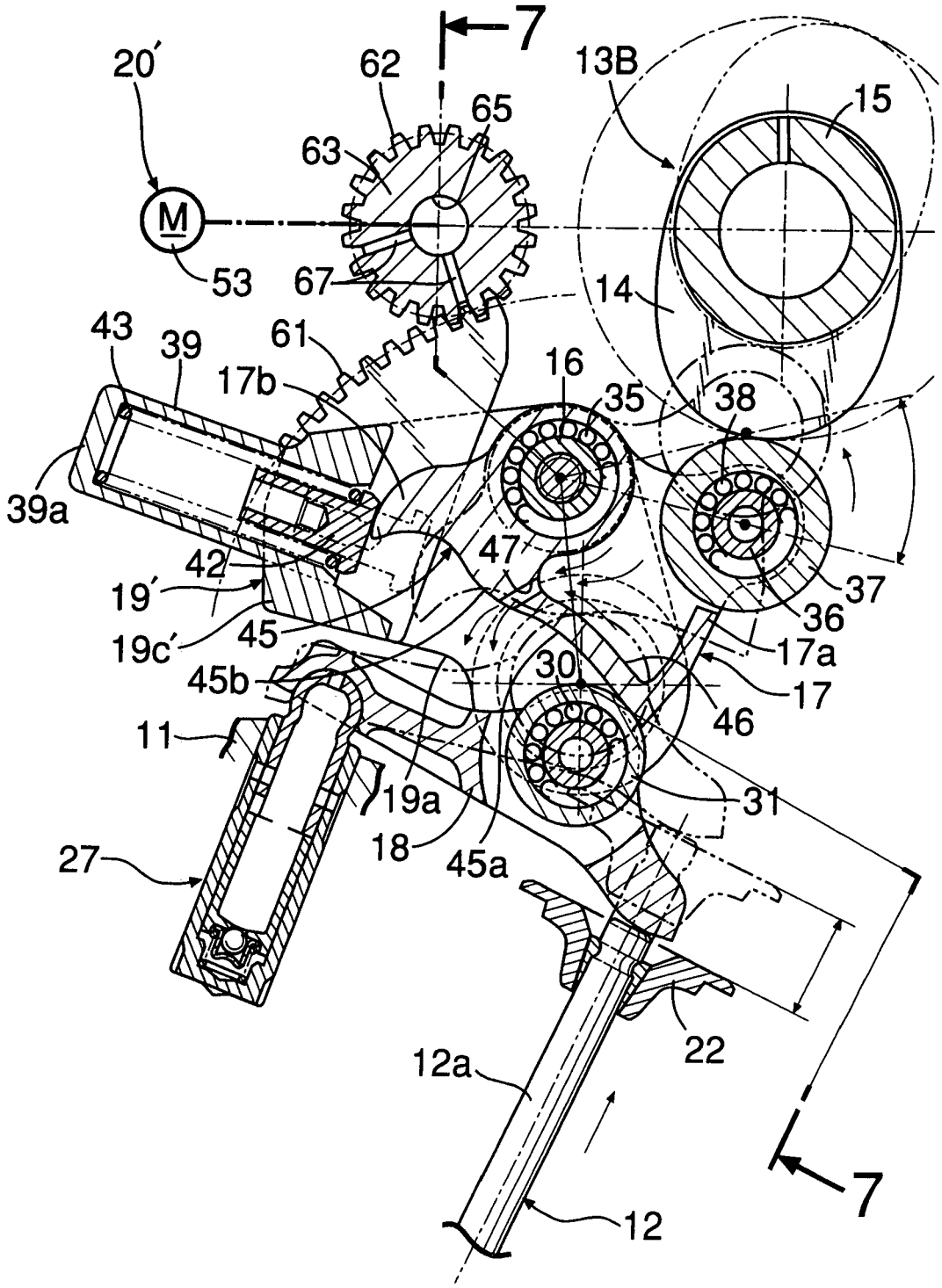
FIG. 9 is a cross-sectional view taken along line 9-9 in FIG. 7 and illustrating a high-lift state.

When the third roller 50 is disposed in a position shown in FIG. 3 by the driver 20, upper ends of the stems 12*a* are driven in opening directions by ends, opposite from the base circle portions 45*n*, of the lift portions 45*a* of the subsidiary cams 17 turned about the axis of the movable support shaft 16. In this state, the lift amount hof the intake valves 12 is the maximum. When the third roller 50 is turned upwards, as shown in FIG. 9, by the driver 20, for example, the upper ends of the stems 12*a* are brought into abutment against the base circle portions 45*b* of the subsidiary cams 17. In this state, the lift amount h of the intake valves 12 is the minimum, that is, h=0.

To lubricate the shaft portions 19*a* of the control arm 19, annular recesses 54 and 55 are provided in inner surfaces of the support bores 32 and outer surfaces of the shaft portions 19*b* to correspond to each other. Also, oil passages 56 are provided in the cam holders 25 to lead to the annular recesses 54 in the inner surfaces of the support bores 32. Annular recesses 57 are also provided in the inner peripheries of the cam holders 25 and the caps 26 at portions supporting the shaft portions 52*a* of the drive shaft 52 to lead to the annular recesses 56. Moreover, an oil passage 58 is provided in the shaft portions 52*a* and the connecting portion 52*b* of the drive shaft 52 to extend in one straight line; communication bores 59 providing communication of the oil passage 58 with the annular recesses 57 are provided in the shaft portions 52*a* of the drive shaft 52; and an ejection bore 60 for ejecting the oil in the oil passage 58 toward the third roller 50 is provided along a central portion of the connecting portion 52*b* in the longitudinal direction. Thus, the oil ejected from the ejection bore 60 is not only supplied for the lubrication of an area between the third roller 50 and the clamping portion 52*c*, but also accumulated in the oil sumps 47 in the subsidiary cams 17 as a result of colliding against the third roller 50 to be scattered.

The operation of the first embodiment of the present invention will be described below. The oil sumps 46 are provided in the upper surface of the subsidiary cams 17. The abutment faces 45 include lift portions 45*a* that turnably drive the cam followers 18 and the base circle portions 45*b* and are equally spaced from the axis of the movable support shaft 16 to retain the cam followers 18 in the rest state. The lift portions 45*a* are provided on the subsidiary cams 17 and abut against the first rollers 31 of the cam followers 18. Moreover, the lubricating oil bores 47 are provided in the subsidiary cams 17.

Therefore, lubrication of the contacting portions of the subsidiary cams 17 and the cam followers 18 is achieved using a simple lubricating structure in which oil is supplied from the oil sumps 46 in the upper surfaces of the subsidiary cams 17, through the lubricating oil bores 47 to the abutment faces 45 provided on the subsidiary cams 17 to come into abutment against the first rollers 31 of the cam followers 18.

Moreover, the lubricating oil bores 47 open into the base circle portions 45*b* of the abutment faces 45 on which a large load does not act, thereby eliminating concerns about decreasing the rigidity of the subsidiary cam 17 due to the provision of the lubricating oil bore 47.

The movable support shaft 16 having the subsidiary cams 17, 17 swingably carried thereon is detachably mounted to the control arm 19. As such, the operation of detaching the subsidiary cams 17, 17 is carried out without removing the other components such as the cam followers 18, thereby simplifying and facilitating replacement of parts. In addition, although it is difficult to form a lubricating oil passage within the movable support shaft 16, because the movable support shaft 16 is attachable to and detachable from the control arm 19, lubrication of the contact portions of the subsidiary cam 17 and the cam follower 18 is easily carried out using the oil supplied from the oil sump 46 through the lubricating oil bore 47.

Further, the spacer 33, which is separate from the movable support shaft 16, is fitted over an outer periphery of the movable support shaft 16 and interposed between the subsidiary cams 17, 17. Therefore, the positions of the subsidiary cams 17 can be defined in a direction along the axis of the movable support shaft 16, while simplifying the shape of the movable support shaft 16.

FIGS. 7 to 10 illustrate a second embodiment of the present invention, wherein portions or components corresponding to those in the first embodiment are designated by the same reference numerals and symbols.

A valve-operating system 13B for opening and closing intake valves 12 includes a camshaft 15 having valve-operating cams 14 which individually correspond to a pair of intake valves 12; a pair of subsidiary cams 17 swingably carried on a movable support shaft 16 that is displaceable in a plane perpendicular to the rotational axes of the valve-operating cams 14, and which swing following the respective valve-operating cams 14; a pair of cam followers 18, 18, each follower 18 being operatively connected to the intake valves 12 and adapted to follow the subsidiary cams 17; a control arm 19' connected to the movable support shaft 16 and turnable about an axis parallel to an axis of the camshaft 15; and a driver 20' for turning the control arm 19.

The subsidiary cams 17 have abutment faces 45 provided on lower surfaces, wherein the first rollers 31 of the cam followers 18 are brought into rolling contact with the abutment faces 45. Each abutment face 45 includes a lift portion 45*a* for turnably driving the cam follower 18 connected with a base circle portion 45*b* equally spaced apart from the movable support shaft 16 to retain the cam follower 18 in a rest state. The subsidiary cams 17 have lubricating oil bores 47 provided therein for guiding oil 46 in oil sumps 46 provided in upper surfaces of the subsidiary cams 17 to the base circle portions 45*b* of the abutment faces 45.

The control arm 19' is formed into an integral crank-shape including webs 19*a* disposed on opposite sides of the intake valves 12; shaft portions 19*b* perpendicularly connected to outer surfaces of the base ends of the webs 19*a* and have axes parallel to the camshaft 15; and a connecting portion 19*c*', which interconnects leading ends of the webs 19*a*. The shaft portions 19*b* are turnably fitted into support bores 32 provided in the cam holders 25. Thus, the control arm 19' is turnably carried by the cam holders 25.

The driver 20' includes a driven gear 61 which is a sector gear provided at an intermediate portion between both guide tubes 39 in the connecting portion 19*c*' of the control arm 19'; a driving gear 62 meshed with the driven gear 61; and an electric motor 53 operatively connected to the driving gear 62.

The driving gear 62 is provided on a turnable shaft 63 turnably carried between the cam holders 25 and caps 26, and is operatively connected to the electric motor 53. Moreover, annular recesses 64 are provided on inner peripheries of the cam holders 25 and the caps 26 at portions supporting the turnable shaft 63 to lead to oil passages 56 in the cam holders 25. The turnable shaft 63 is provide with an oil passage 65 extending in one straight line, and communication bores 66 providing communication of the oil passage 65 with the annular recesses 64. Further, the turnable shaft 63 is provide with ejection bores 67, 67 for ejecting the oil within the oil passage 65 toward meshed portions of the driving gear 62 and the driven gear 61, so that the oil ejected from the ejection bores 67, 67 is not only supplied for the lubrication of the meshed portions of the driving gear 62 and the driven gear 61, but also accumulated in the oil sumps 46 as a result of being scattered.

Figure 10:
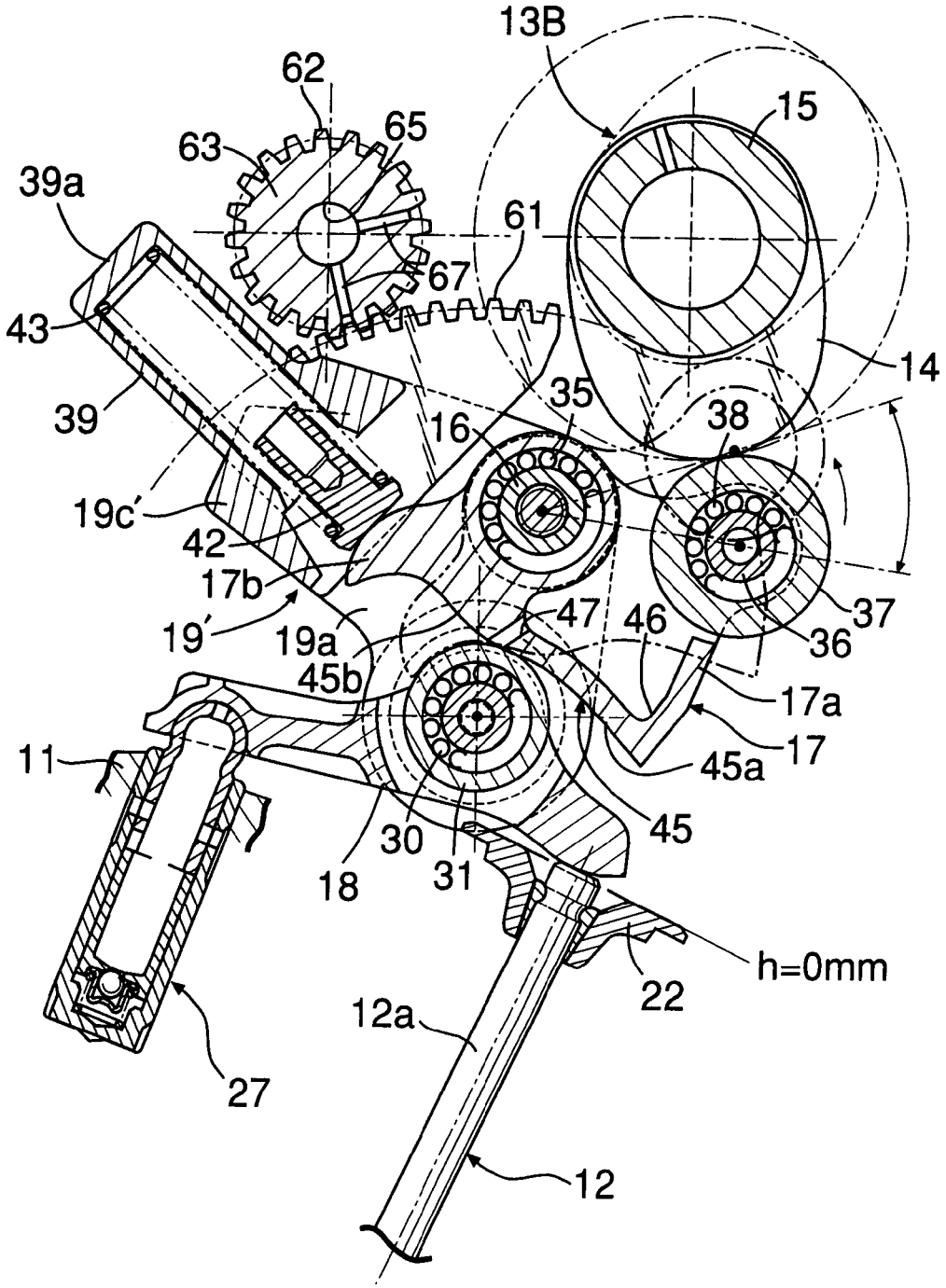
FIG. 10 is a cross-sectional view illustrating a high-lift state.

Thus, in a state in which the driving gear 62 has meshed with an end of the driven gear 61 closer to the camshaft 15, as shown in FIG. 9, upper ends of the stems 12*a* of the intake valves 12 are driven in opening directions by ends, opposite from the base circle portions 45*b*, of the lift portions 45*a* of the abutment faces 45 of the subsidiary cams 17 turned about the axis of the movable support shaft 16. In this state, the lift amount $\underline{h}$of the intake valves 12 is the maximum. On the other hand, in a state in which the driving gear 62 has meshed with an end of the driven gear 61 opposite the camshaft 15, as shown in FIG. 10, for example, the upper ends of the stems 12*a* of the intake valves 12 are in abutment against the base circle portions 45*b* of the abutment faces 45 of the subsidiary cams 17. In this state, the lift amount $\underline{h}$ of the intake valves 12 is the minimum, that is, $\underline{h}=0$.

Moreover, the ejection bores 67, 67 are provided in the turnable shaft 63 at two points circumferentially spaced apart from each other in such a manner that the oil is supplied to the meshed portions of the driving gear 62 and the driven gear 61, even if the driving gear 62 is either in a state in which it has meshed with the end of the driven gear 61 closer to the camshaft 15, or in a state in which it has meshed with the end of the driven gear 61 opposite from the camshaft 15.

As a result, the second embodiment provides the same effect as the first embodiment.

The present invention is not limited to the above-described embodiments, and various modifications in design may be made without departing from the spirit and scope of the invention defined in the claims.

What is claimed is:

1. A lift-variable valve-operating system for an internal combustion engine, comprising:

a subsidiary cam swingably carried on a movable support shaft that is displaceable in a plane perpendicular to a rotational axis of a valve-operating cam and which swing follows the valve-operating cam;

a cam follower operatively connected to an engine valve and which is operated to follow the subsidiary cam, wherein a lift amount of the engine valve is varied by displacing the movable support shaft, a control arm connected to the movable support shaft and which is turnable about an axis parallel to the rotational axis of the valve-operating cam; and drive means for turnably driving the control arm, wherein the subsidiary cam is provided with an abutment face, wherein the abutment face of the subsidiary cam abuts against the cam follower, and includes a lift portion for turnably driving the cam follower; and a base circle portion connected to the lift portion and equally spaced apart from the axis of the movable support shaft to retain the cam follower in a rest state, and wherein the control arm includes webs disposed on opposite sides of the engine valve, and a connecting portion which interconnects leading ends of the webs.

2. The lift-variable valve-operating system according to claim 1, wherein the connecting portion is integrally provided with a bottomed cylindrical guide tube.

3. The lift-variable valve-operating system according to claim 1, wherein the drive means abuts against the connecting portion.

4. The lift-variable valve-operating system according to claim 2, wherein the drive means abuts against the connecting portion.

5. The lift-variable valve-operating system according to claim 3, wherein the connecting portion is integrally provided with a pair of arm portions; a roller is supported on a support shaft mounted between leadings ends of the arm portions; and the drive means includes a drive shaft having a clamping portion for clamping the roller.

6. The lift-variable valve-operating system according to claim 4, wherein the connecting portion is integrally provided with a pair of arm portions; a roller is supported on a support shaft mounted between leading ends of the arm portions; and the drive means includes a drive shaft having a clamping portion for clamping the roller.

7. The lift-variable valve-operating system according to claim 5, wherein the connecting portion is integrally provided with bottomed cylindrical guide tubes; and the pair of arm portions are integrally provided between the guide tubes.

* * * * *